United States Patent [19]

Swinkels

[11] 4,005,951

[45] Feb. 1, 1977

[54] ROTARY VANE ENGINE WITH ORBITING INNER AND OUTER MEMBERS

[75] Inventor: Dominicus Adrianus Johannes Swinkels, Trigg, Australia

[73] Assignee: The Broken Hill Proprietary Company Limited, Melbourne, Australia

[22] Filed: Feb. 27, 1974

[21] Appl. No.: 446,478

[30] Foreign Application Priority Data

Mar. 1, 1973 Australia ..... 2450/73

[52] U.S. Cl. ..... 418/61 R; 418/63; 418/256

[51] Int. Cl.[2] ..... F01C 1/02; F03C 3/00

[58] Field of Search ..... 418/59, 61 R, 63, 172, 418/175, 177, 256, 257

[56] References Cited

UNITED STATES PATENTS 3,358,653 12/1967 Grimm ..... 418/59
3,381,668 5/1968 Agren ..... 418/61 R
3,812,828 5/1974 Griffiths ..... 418/61 R

FOREIGN PATENTS OR APPLICATIONS 529,406 7/1931 Germany ..... 418/59

*Primary Examiner*—John J. Vrablik

[57] ABSTRACT

An engine of the rotary or orbital type having a piston member mounted to move eccentrically within a housing with a plurality of vanes disposed between the piston member and the housing to form a number of chambers which vary in volume as a piston member orbits within the housing. Each vane is supported in the piston member or housing for radial sliding movement as the piston member orbits and the vanes are mechanically controlled between respective sets of parallel surfaces which engage radially spaced portions of the vane to prevent radial movement of the vane relative to these surfaces while allowing lateral movement of the vanes along the surfaces as the piston member orbits.

6 Claims, 6 Drawing Figures

ROTARY VANE ENGINE WITH ORBITING INNER AND OUTER MEMBERS

This invention relates to a vane-type motor which may be operated on the internal combustion engine principle, but may also operate as a steam engine or hydraulic motor.

There have been proposed numerous constructions of rotary motors, many incorporating sliding vanes which divide a cavity formed between a stationary and rotary or orbital member into a plurality of chambers. A common problem encountered in previously proposed vane-type motors is the provision of adequate support for the sliding vanes, and the maintaining of an effective seal between the sliding vanes and the stationary and rotary members. It has been the practice to support the vane for reciprocating sliding movement either in the stationary or in the rotary member with the projecting portion of the vane completely unsupported. Suitable spring devices may be provided to urge the vanes in a direction to maintain engagement between the free end of the vane and the rotary or stationary member as the case may be.

It is the principal object of the present invention to provide a motor of the vane-type, in which the supporting and sealing problems inherent in previously proposed vane-type motors are substantially reduced to provide an effective motor.

With the above stated object in view, there is provided an engine comprising a housing having a cavity defined by an internal peripheral wall and opposed end walls, a shaft rotatably supported in the housing, a piston member journalled eccentrically on said shaft to describe an orbital path within the cavity upon relative rotation between the shaft and housing, a plurality of vanes to divide the cavity between the housing and the piston member into a number of chambers, each vane being slidably supported in radial slots in the housing or the piston member for movement in the radial direction relative to the shaft, and the vane engages a peripheral surface of the other member defining the working cavity, sealing means operatively disposed between each vane and the various surfaces of the housing and piston member contacted by the vane, the volume of each chamber varying as the piston member orbits.

To ensure a positive seal between the end of the vane and the surface of the piston member or the housing which it engages, the end of the vane is provided with a surface seal, that is, a surface of sufficient width and of the same radius of curvature as the mating piston or housing surface to which it must seal. The vane is mechanically restricted between two parallel surfaces - one formed on the piston or housing and the other outside the housing or inside the piston. The radial slots allow the vanes to freely move in the radial direction with respect to the slotted member as the restricting parallel surfaces engaging the ends of each vane move in unison, while provision is made on the parallel restricting surfaces to allow lateral movement of the vanes with respect to the restricting surfaces.

Accordingly, it is not necessary to provide any spring devices to induce the reciprocating movement of the vanes, nor is it necessary to make a direct mechanical connection between the vanes and the piston member as has otherwise been proposed.

The means of ensuring a mating surface seal at the butted end of the vane, and providing the mechanical restriction at the other end of the vane to ensure its proper radial movement may be more readily understood from reference to the accompanying drawings showing, in principle, several examples of engines utilizing the invention.

Figure 1:
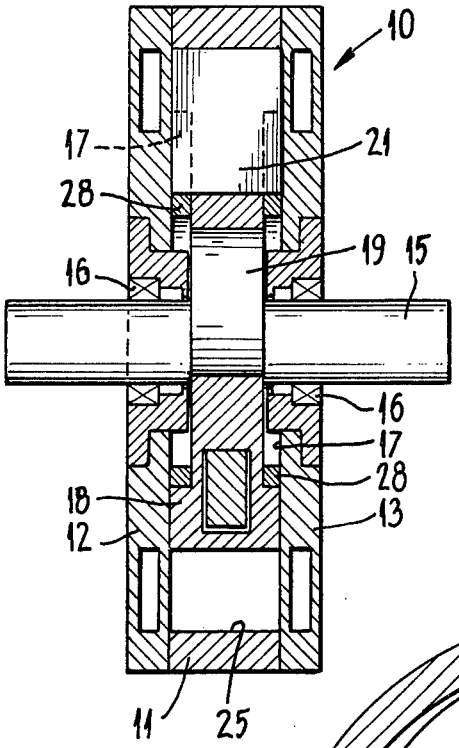
FIGS. 1 and 2 are axial and diametral sections of an embodiment of the engine having three vanes, three radial slots in the orbiting piston and flat sealing surfaces between the vanes and the housing.

The drawings illustrate the principles of several preferred embodiments of the inventive engine with specific numbers of vanes. However, the engine is operable with two or more vanes in any of the embodiments illustrated and those skilled in the art will understand that the various construction details can be varied widely within the scope of the invention, and can be applied to many different engines within the spirit of the invention.

The specification assumes that the engine housing is fixed in place and the piston and vanes move within the housing, but the required motion is merely relative, and the same result can be achieved by fixing the internal engine members in place and moving the housing relative to these.

The directions of rotation of engine components are arbitrary, and the relative rotation between the engine housing and its inner components can be in either direction. Similarly, specification references to "top", "bottom", "front", "back", etc. refer to the orientation of the inventive engine in the drawings, and the inventive engine and its components can be oriented in a variety of ways.

The inlet and exhaust ports to each chamber for the working fluid are shown in a simplified manner in order to simplify the drawings but the construction of such components and the application thereof to rotary or orbital engines are well-known and may be readily applied to the engines illustrated by those skilled in the art. Also, a variety of means for igniting the charge cooling and lubrication of the engine, counter balancing the moving parts, arranging bearings, and other details, are known to those skilled in the art, can widely varied within the spirit of the invention.

Figure 2:
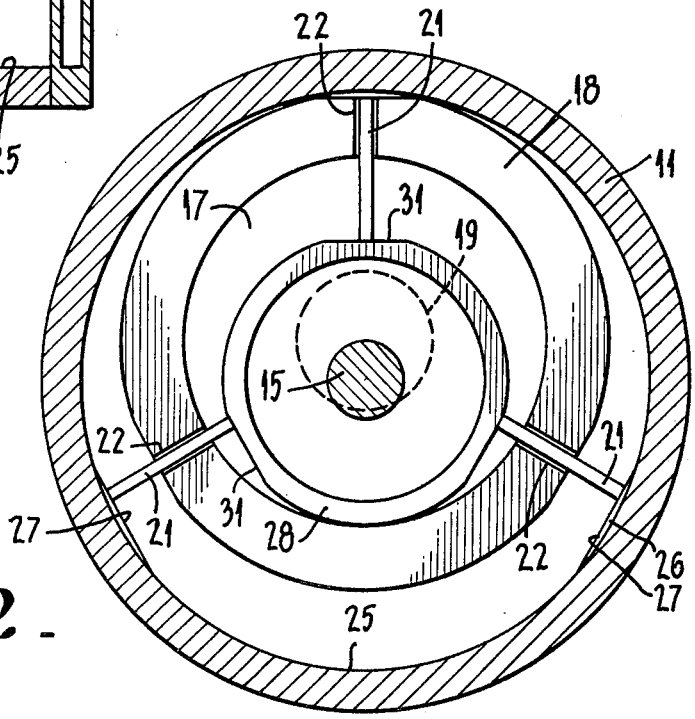

Referring firstly to FIGS. 1 and 2 of the drawings, there is shown therein a three chamber engine having a housing 10 formed by a peripheral member 11 and two end plate members 12 and 13 secured to the peripheral member 11 to define a cavity therein. The crank shaft 15 is journalled in bearings 16 mounted in the end plates for rotation about an axis generally coaxial with the housing 10. The piston member 18 is mounted coaxially on the eccentric portion 19 of the crank shaft 15. The three vanes 21 are supported in respective slots 22 in the piston member 18 for linear sliding movement relative thereto in a direction radial to the axis of the eccentric 19 on which the piston member is journalled.

The axial end face of the piston and of each vane have a sealing relationship with the internal face of the end plates 12 and 13, preferably by the provision of sealing elements therebetween, and the vanes seal against the internal surface of the peripheral member 11 and the slot 22 in the piston member, so that the cavity formed between the housing and the piston member is divided by the vanes into three compartments, which vary in sequence in volume as the piston orbits within the housing upon rotation of the crank.

The internal surface 25 of the peripheral member 11 is of generally cylindrical form, but is provided with three equally spaced pads 26. The pads 26 present to the respective vanes 21 a flat face 27 extending in a direction at right angles to the radial plane of movement of the vane within the piston member, and extending the full width of the cavity defined by the housing 10. A pair of rings 28 are disposed concentric with the crank shaft 15, and hence to the housing peripheral member 11, and are secured to the end plates 12 and 13 respectively. The axial end faces of the piston member 18 are provided with recesses 17 to receive the respective ring members so that the ring members do not interfere with the orbital movement of the piston within the housing, and to maintain an annular face on each side of the piston member, radially outwardly of the ring members, to enable appropriate seals to be carried thereby between the piston member and the end plates.

Each ring member 28 has three flat surfaces 31 thereon equally spaced around the periphery thereof, with one face parallel to each of the flat faces of the pads 26 on the inner periphery of the member 11. The radially inner end vane engages with a respective face 31 so that, in the radial direction, the vane is restrained against radial movement between the flat faces 27 and 31. As the piston member orbits within the housing, the vane will move in a direction at right angles to their radial movement across these flat surfaces, but there will be no radial movement of the vane in respect of these surfaces.

Although the surfaces 27 and 31 have been referred to as flat parallel surfaces, it will be appreciated that they may take other shapes provided the radial distance, with respect to the axis of the piston member, between the two surfaces is constant at all points along the lengths of the surfaces in the direction of the movement of the vanes therealong. Thus, for example, the peripheral surface of the ring members 31 may be purely circular and the pads 27 on the internal surface of the periphery member 11 may be curved, having the same radius of curvature as the periphery of the ring member. Equally there may be no pads on the internal surface of the peripheral member 11, which may have a purely cylindrical surface, and corresponding portions of equal radius of curvature may be provided on the ring member to engage the inner end of each vane.

Figure 3:
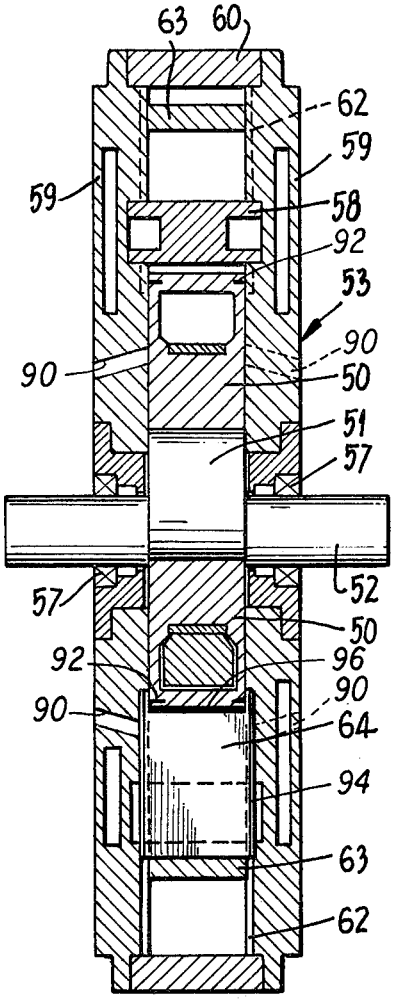
FIGS. 3 and 4 are views similar to FIGS. 1 and 2 of an embodiment of the engine having six vanes and six radial slots in the stationary housing and the vanes engaging the internal peripheral wall of a floating ring external of the housing.
Figure 4:
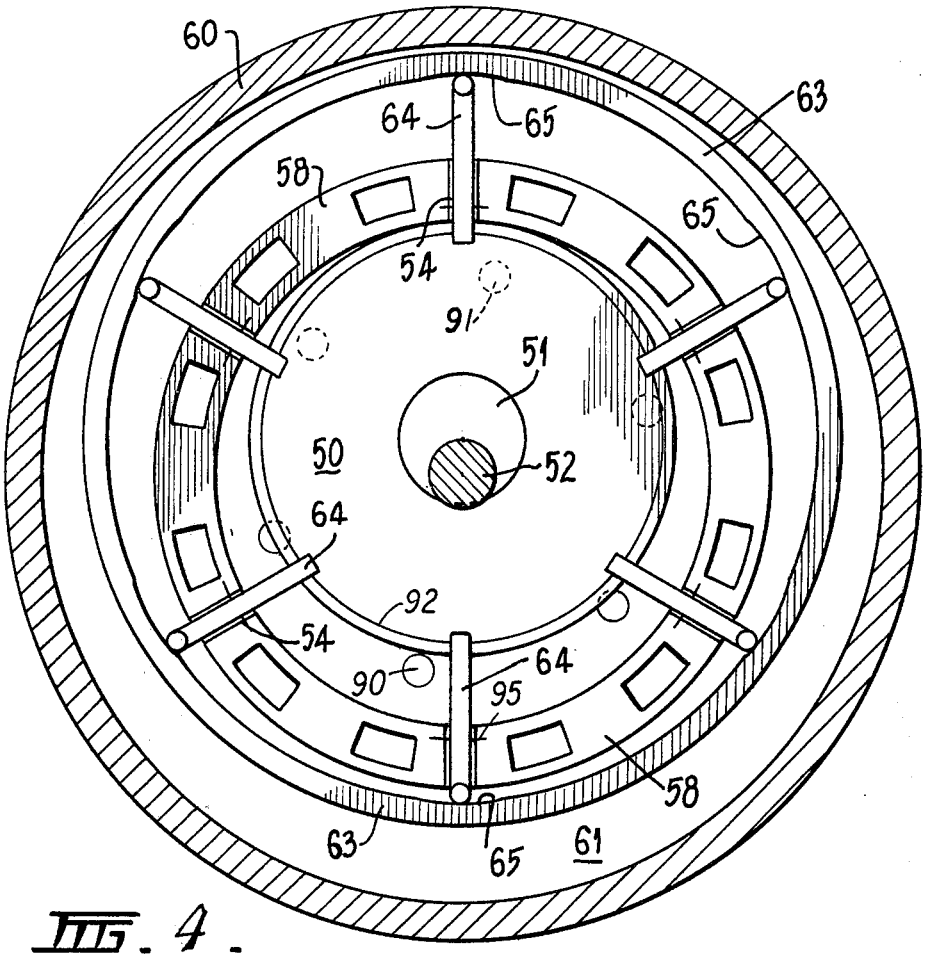

In an alternative engine construction, as shown in FIGS. 3 and 4, the piston member 50 is again supported on the eccentric 51 of the crank shaft 52 to orbit within the housing 53 formed by the peripheral ring member 58 and the end plates 59. The crank shaft 52 is supported in bearings 57 in the end plates, and the end plates extend radially outwardly beyond the peripheral ring member 58 to cooperate with an outer casing member 60 to define a further cavity 61 in which is located floating control ring 63.

Six vanes 64 extend between the periphery of the piston member 50 through slots 54 in the housing, disposed radially with respect to the axis of the crank shaft 52, to engage at their outer end the inner surface of the control ring 63. The external surface of the piston member 50 is of pure cylindrical form, with the radially inner end of each vane in engagement therewith, whilst the radially outer end of each vane engages a shallow recess 65 in the inner surface of the floating control ring 63, the surface of each recess having the same radius of curvature as the peripheral surface of the piston 50, and with the centre of curvature in the plane of radial movement of the vane. Inlet and exhaust ports are shown in simplified fashion, as are annular piston seals 92 and vane seals 94, 95 and 96.

In this form of the engine, as the crank shaft 52 rotates and the piston member 50 orbits within the housing, the vanes 64 are caused to move radially in the slots 54 with respect to the housing, and the vanes impart to the floating control ring 63 an orbital movement corresponding to the orbital movement of the piston 50. Suitable seals are provided in the slots 54 to engage with the vanes as they slide therein, and between the radially inner end of the vanes and the cylindrical surface of the piston member 50. Likewise, seals are provided between the vanes and the inner surfaces of the end plates 59. In the particular construction shown, radial grooves 62 are provided in each end plate to receive the vanes, and thus provide additional support and guidance for the vanes during their radial movement.

It will also be appreciated that the cylindrical surface of the piston 50, and the curved surface of the recess 65 in the floating control ring may be replaced by parallel flat sections on the surface of the piston member and floating ring respectively, along which the vanes may move in a direction at right angles to their radial movement during the orbiting of the piston.

Figure 5:
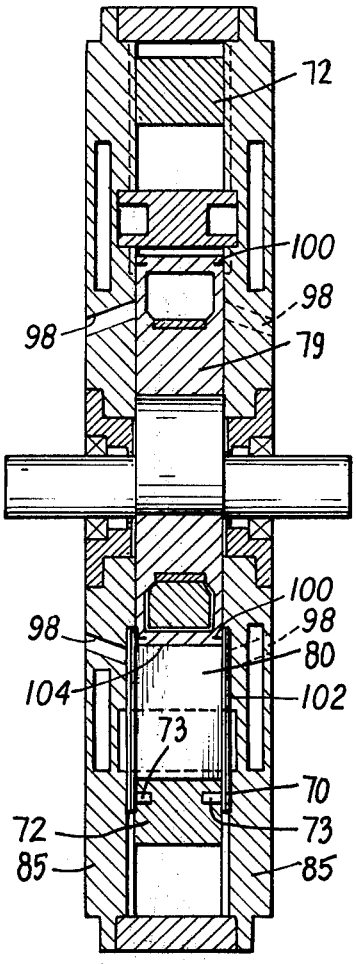
FIGS. 5 and 6 are views similar to FIGS. 1 and 2 of an embodiment of the engine having four working chambers, the vanes moving in radial slots in the housing, with the vanes being mechanically connected to a ring external of the housing.
Figure 6:
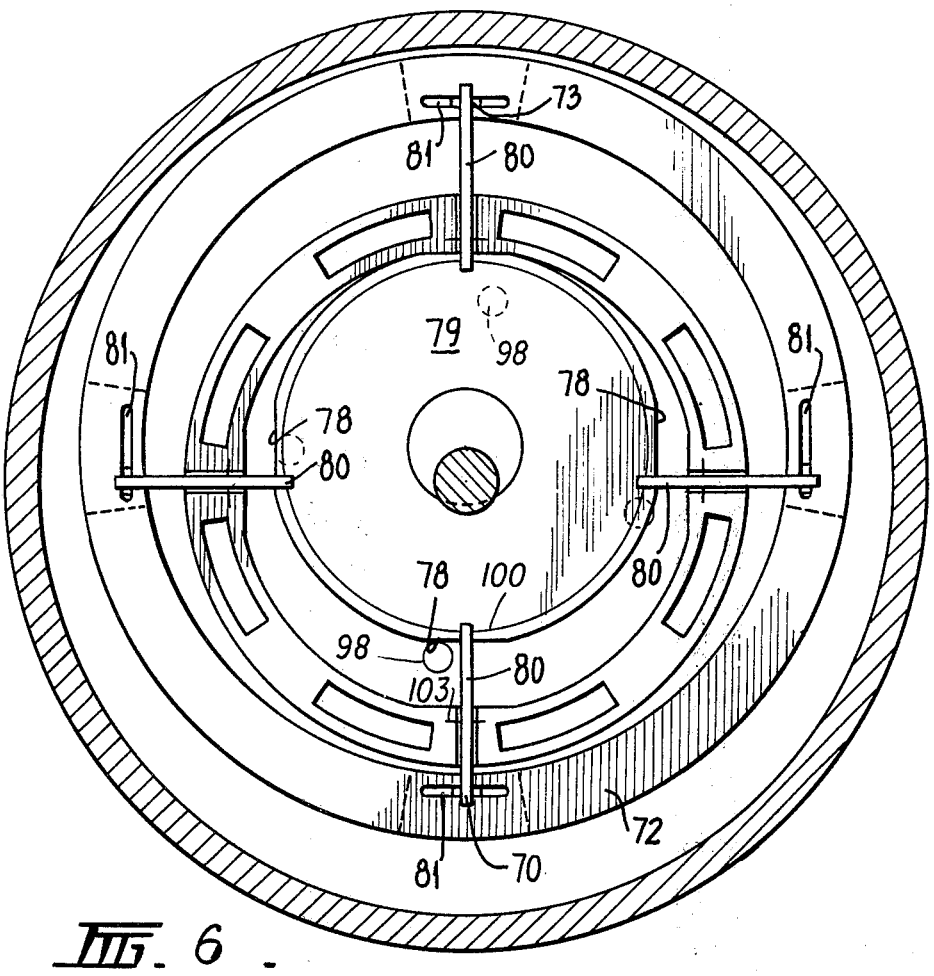

FIGS. 5 and 6 of the drawings show a modification of the engine disclosed in FIGS. 3 and 4 wherein the vanes are constrained between the surface of the piston and the floating ring located externally of the housing. In this construction, four vanes 80 are used to provide a four chamber engine and the piston 79 is provided with four equally spaced flat surfaces 78 on its periphery, one to cooperate with the radially inner end of each vane 80.

The vanes at their outer ends are provided with respective legs 70 which extend on either side of the floating control ring 72, and each carry pins 73 which engage in slots 81 in the side faces of the ring 72. The slots 81 have radially spaced parallel sides and each side is parallel to the flat surface 78 on the periphery of the piston with which the corresponding vane cooperates. Thus, as the piston member orbits within the housing, each vane 80 will move radially relative to the housing 82 through the respective slots 83 therein, whilst the inner end of the vane will slide across the flat surface 78 on the piston in a direction at right angles to the direction of radial movement, and the pins 73 in the outer portion of the vane, externally of the housing will move in a similar direction within the slots 81 in the floating control ring. Inlet and exhaust ports 98 are shown in simplified fashion, as are annular piston seals 100 and vane seals 102, 103 and 104.

It will also be realized that, if the portion of the piston surface with which the vane engages, is curved, the slots 81 in the control ring would also be curved with a mean radius of curvature equal to that of the corresponding surface on the piston.

In yet a further modification of this construction, the control ring may be located externally of the end plates 85 of the engine, preferably having one ring adjacent each end plate, with pins extending from each vane outwardly through radial slots in the end plates to engage slots in the external control rings. The slots in the control rings would, of course, extend in a direction at right angles to the radial slots of the housing similar to the slots 81. The advantage of this construction is that the overall dimension of the engine may be reduced, as the control ring is not required to be located about the periphery of the housing, with sufficient clearance to undergo the required orbital movement. By locating the rings on opposite sides of the housing, and particularly if pins on the vanes are not located at the outer extremity of the vane, the actual outside diameter of the floating ring is substantially reduced and may be less than the outside dimensions of the housing.

I claim:

1. An engine comprising a housing including an internal peripheral wall and opposed end walls, a shaft rotatably supported in the housing, a piston member journalled eccentrically on said shaft to describe an orbital path within said housing upon relative rotation between said shaft and said housing, said piston member defining with said internal peripheral wall and said end walls a working cavity, a plurality of vanes disposed generally radially to the axis of said shaft and supported in said housing for reciprocal movement radially with respect to the axis of said shaft, and for lateral movement between a first position in radial alignment with a radius of said piston member and a plurality of second positions on either side of said first position and wherein said vanes are parallel to said first position, said vanes being mechanically controlled between two sets of parallel control surfaces to prevent radial movement of said vanes relative to said parallel control surfaces while allowing lateral movement of said vanes along said control surfaces between said first position and said second positions, one set of said parallel control surfaces being located on the periphery of said orbiting piston member, the other set of said parallel control surfaces being located on vane controlling member or members located outside said working cavity, said vane controlling member or members moving in an orbital path about said shaft axis as said piston orbits, sealing means operatively disposed between each said vane and said piston member, said housing peripheral wall and said housing end walls to divide said working cavity into a plurality of chambers, the volume of each said chamber varying as said piston member orbits, and means to regulate the admission to and exhausting from each said chamber in sequence of a working fluid to induce orbiting of said piston member and the resultant relative rotation between said shaft and said housing.

2. An engine as claimed in claim 1 wherein said ring member extends about said periphery housing.

3. An engine as claimed in claim 1 wherein said other set of control surfaces are formed on a ring member disposed externally of said working cavity, and said vanes extend through respective slots in said housing to engage said ring member.

4. An engine as claimed in claim 3 wherein said other set of control surfaces are formed on the internal periphery of said ring member.

5. An engine as claimed in claim 3 wherein each control surface of said other set of control surfaces comprises a flat surface parallel to a complementary flat control surface of said one set of said control surfaces on the periphery of the said piston.

6. An engine as claimed in claim 5 wherein each of said flat surfaces formed on said ring member comprises a wall of a respective slot formed on the ring member, each said slot being parallel to the corresponding control surface on said piston, each said vane having a portion thereof extending into the respective said slot.

* * * * *